United States Patent [19]

Fewel

[11] 4,288,165

[45] Sep. 8, 1981

[54] VIBRATORY ACTUATOR INCORPORATING HYDRODYNAMIC JOURNAL BEARING

[75] Inventor: Kenneth J. Fewel, Nacogdoches, Tex.

[73] Assignee: The Hutson Corporation, Arlington, Tex.

[21] Appl. No.: 66,672

[22] Filed: Aug. 15, 1979

[51] Int. Cl.[3] ..... B01F 11/00

[52] U.S. Cl. ..... 366/124; 74/87; 366/128

[58] Field of Search ..... 366/124, 125, 128, DIG. 600; 74/87, 571 M; 308/9, DIG. 1

[56] References Cited

U.S. PATENT DOCUMENTS

| | | | |
|---|---|---|---|
| Re. 20,305 | 3/1937 | Klahn | 308/9 |
| Re. 27,084 | 3/1971 | Balz | 51/163 |
| 1,057,773 | 4/1913 | Pratt . | |
| 2,722,840 | 11/1955 | Kececioglu | 74/87 |
| 2,729,518 | 1/1956 | O'Connor | 308/9 |
| 2,818,184 | 12/1957 | Matson | 366/124 X |
| 3,049,383 | 8/1962 | Loch | 308/9 |
| 3,073,059 | 1/1963 | Balz | 51/7 |
| 3,073,078 | 1/1963 | Balz | 51/163 |
| 3,134,207 | 5/1964 | Ferrara | 366/128 X |
| 3,260,509 | 7/1966 | Rudy | 366/124 |
| 3,266,739 | 8/1966 | McKibben | 366/128 |
| 3,318,051 | 5/1967 | Rampe | 51/163 |
| 3,395,948 | 8/1968 | Andrews | 308/9 |
| 3,456,992 | 7/1969 | Kulina | 308/9 |
| 3,539,116 | 11/1970 | Podmore | 241/172 |
| 3,650,582 | 3/1972 | Casey | 308/36.3 |
| 3,747,470 | 7/1973 | Inoue | 90/11 A |
| 3,747,639 | 7/1973 | Eickmann | 137/625.24 |
| 3,753,016 | 8/1973 | Klein | 310/90 |
| 3,785,708 | 1/1974 | Miyasaki | 308/9 |
| 3,954,309 | 5/1976 | Hutson | 308/9 |

FOREIGN PATENT DOCUMENTS

| | | |
|---|---|---|
| 834959 | 5/1960 | United Kingdom . |
| 1130143 | 10/1968 | United Kingdom . |
| 1233140 | 5/1971 | United Kingdom . |
| 1351432 | 5/1974 | United Kingdom . |
| 1435499 | 5/1976 | United Kingdom . |
| 1449370 | 9/1976 | United Kingdom . |

*Primary Examiner*—Edward J. McCarthy

*Attorney, Agent, or Firm*—Richards, Harris & Medlock

[57] ABSTRACT

A vibratory actuator (22) includes a housing (62), a rotatable shaft, (78) extending through the housing, and an eccentric member (80) to which the shaft is secured. Vibration is effected upon rotation of the eccentric member (80) by the shaft (78). A hydrodynamic fluid film gap is provided between a partial cylindrical journal surface of the eccentric member (80) and a full cylindrical bearing surface of the housing (62), and the housing contains hydrodynamic fluid. Radial loading between the housing (62), shaft (78) and eccentric member (80) is more uniformly distributed to reduce structural deflections and thus facilitate maintenance of the proper film of hydrodynamic fluid during operation of the actuator (22). If desired, the fluid can be circulated through the housing (62) for cooling purposes.

22 Claims, 6 Drawing Figures

VIBRATORY ACTUATOR INCORPORATING HYDRODYNAMIC JOURNAL BEARING

TECHNICAL FIELD

The present invention relates generally to an actuator for a vibratory machine, and more particularly to an actuator which combines hydrodynamic journal bearing structure with an eccentrically weighted shaft to effect vibratory actuation.

BACKGROUND ART

Vibratory machines are useful in many applications for performing a wide variety of functions including consolidation of disintegrated materials; disintegration of consolidated materials; loosening, separation and transfer of particulate materials; and various machining, finishing and surface treatment operations.

For example, a vibratory finishing machine includes a tub for receiving suitable finishing media along with piece parts to be finished. The finishing media typically comprises a mixture of abrasive material and a suitable liquid, such as water, and may also include a finishing agent. The tub is supported for vibratory motion, and some type of eccentric actuator is employed to gyrate the tub and thereby effect relative movement between the piece parts and finishing media therein to perform the desired function. Polishing, deburring and other finishing operations can thus be performed rapidly on many piece parts simultaneously.

The vibratory machines currently available typically employ eccentric actuators including either a rotatable shaft with eccentric weights mounted thereon, or simply a rotatable eccentric shaft. In either case, the shaft of the eccentric actuator is supported by antifriction bearings of the ball, roller, tapered roller or needle type. However, several problems have arisen in the use of bearings with rolling and non-rolling elements in operating a vibratory machine. The useful lives of such bearings are relatively short because repeated radial loads cause fatigue and localized heat build up leading to early bearing failure. Replacement of the bearings supporting eccentric actuators has been a continual and stubborn problem in the use of vibratory machines.

More recently, hydrodynamic bearings have been employed to support the eccentric actuator in a vibratory machine. Such bearings utilize a thin film of fluid between relative moving parts to reduce the fatigue and heating problems otherwise accompanying direct mechanical contact between the parts. Circulation of the fluid has been especially effective in controlling heat build up in such bearings. Sudden failure can occur, however, if adequate fluid is not maintained between relatively moving parts within a hydrodynamic bearing. Rapid heating due to direct contact between moving parts can occur without adequate hydrodynamic film.

Maintenance of sufficient fluid film within a hydrodynamic bearing has therefore been a critical problem in utilizing such bearings to support the eccentric actuator of a vibrating machine. This has been a particularly difficult problem due to the structural deflection and misalignment which occur during operation of a vibratory actuator, and several attempts have been made to solve it. For example, U.S. Patent No. 3,954,309 assigned to the assignee hereof, discloses a vibrating machine which incorporates the principle of deflection matching between the shaft of the eccentric actuator and the housing within which the hydrodynamic bearings are supported. This approach is effective but somewhat expensive due to the engineering and manufacturing steps that are required to achieve deflection matching. Other approaches have been less effective but equally expensive.

A need has thus arisen for an improved vibratory actuator of inexpensive construction which minimizes structural deflection and misalignment to facilitate maintenance of the proper fluid film in the hydrodynamic bearing.

DISCLOSURE OF INVENTION

The present invention comprises an improved vibratory actuator which overcomes the foregoing and other difficulties associated with the prior art. In accordance with the invention, there is provided an actuator which combines the functions of a hydrodynamic journal bearing and an eccentrically weighted shaft into a single assembly so as to minimize relative deflections which could otherwise deplete the hydrodynamic film. The apparatus herein comprises a housing in which an eccentric weight is mounted for rotation with a shaft extending through the housing. The housing includes suitable fluid lubricant for hydrodynamically supporting the eccentric weight during rotation. Radial loads between the eccentric weight and housing are supported entirely by the hydrodynamic film. One or more of the vibratory units herein can be attached to a vibratory machine to effect actuation thereof and accomplish the desired finishing operation. Advantages of the vibratory apparatus of the present invention include simplified and less expensive construction, improved reliability and safety, ease of adjustability, reduced maintenance and longer useful life.

In accordance with more specific aspects of the invention, there is provided a vibratory unit for attachment to a vibratory mechanism to effect actuation thereof. The unit comprises a housing with a cylindrical interior surface which functions as a full 360° journal bearing. A rotatable partial shaft which functions as an eccentric weight is mounted on the journal inside the housing. Secured to the partial shaft is a smaller central shaft which extends through seals in the housing and provides a means of applying torque to the assembly to cause rotation. The partial shaft/eccentric weight preferably includes a babbitt lined surface. Fluid lubricant is provided in the housing and can be circulated therethrough about the shaft and eccentric weight by means of ports provided in the ends of the housing, if desired. During operation, the outer surface of the eccentric weight corresponds to the journal of a hydrodynamic bearing, while the inner surface of the housing corresponds to the bearing thereof.

In contradistinction to some conventional hydrodynamic bearings which employ partial bearings to support a full shaft which is turning, the actuator herein employs a full bearing portion to support a partial journal portion. Deflection of the journal is thus minimized because the centrifugal loading is uniform across the bearing surface, which in turn facilitates maintenance of a sufficient film of hydrodynamic fluid therebetween.

BRIEF DESCRIPTION OF DRAWINGS

A more complete understanding of the invention can be had by referring to the Detailed Description in conjunction with the Drawings, wherein.

DETAILED DESCRIPTION

Figure 1:
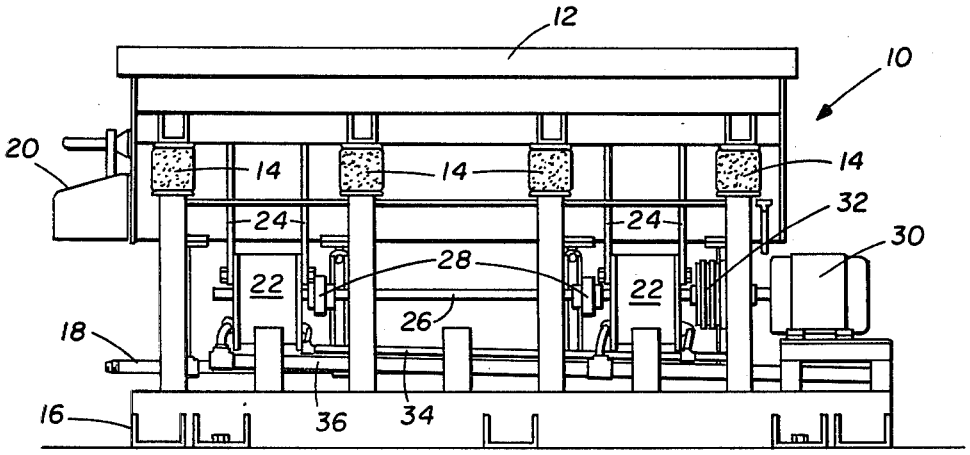
FIG. 1 is a side view of a vibratory machine utilizing the invention.

Referring now to the Drawings, wherein like reference numerals designate like or corresponding parts throughout the several views, and particularly referring to FIG. 1, there is shown a vibratory machine 10 utilizing a pair of the actuators of the present invention. As illustrated, machine 10 comprises a vibratory finishing machine of the type suitable for performing polishing, deburring and other surface treatment operations.

Machine 10 includes a vibratory tub 12 supported by means of a plurality of springs 14 on a frame 16. Tub 12 is of U-shaped cross section and may be provided with suitable covers. Springs 14 may comprise air bags, coil springs or other resilient mountings suitable for supporting vibratory tub 12. Frame 16 can be constructed from channel sections if desired. A drain system 18 is provided for removing liquid from tub 12 at the completion of the finishing operation. A discharge assembly 20 is provided at one end of tub 12 to facilitate removal of finished piece parts from machine 10.

Tub 12 of machine 10 is actuated by a pair of vibratory actuators 22 comprising the invention, each of which is rigidly secured to tub 12 by a pair of brackets 24. Actuators 22 are interconnected by means of shaft 26 and a pair of flexible couplings 28. Both actuators 22 are driven simultaneously by a motor 30 connected to one of the units through a coupling 32. An electric motor, hydraulic motor or any suitable drive means can be utilized as motor 30.

Machine 10 is also provided with a lubrication system including fluid supply and return lines 34 and 36 extending from a source (not shown) of suitable hydrodynamic fluid. Actuators 22 are connected across fluid lines 34 and 36, and an appropriate flow rate is maintained therethrough for cooling and lubrication purposes during operation of the units to be explained more fully hereinafter.

Figure 2:
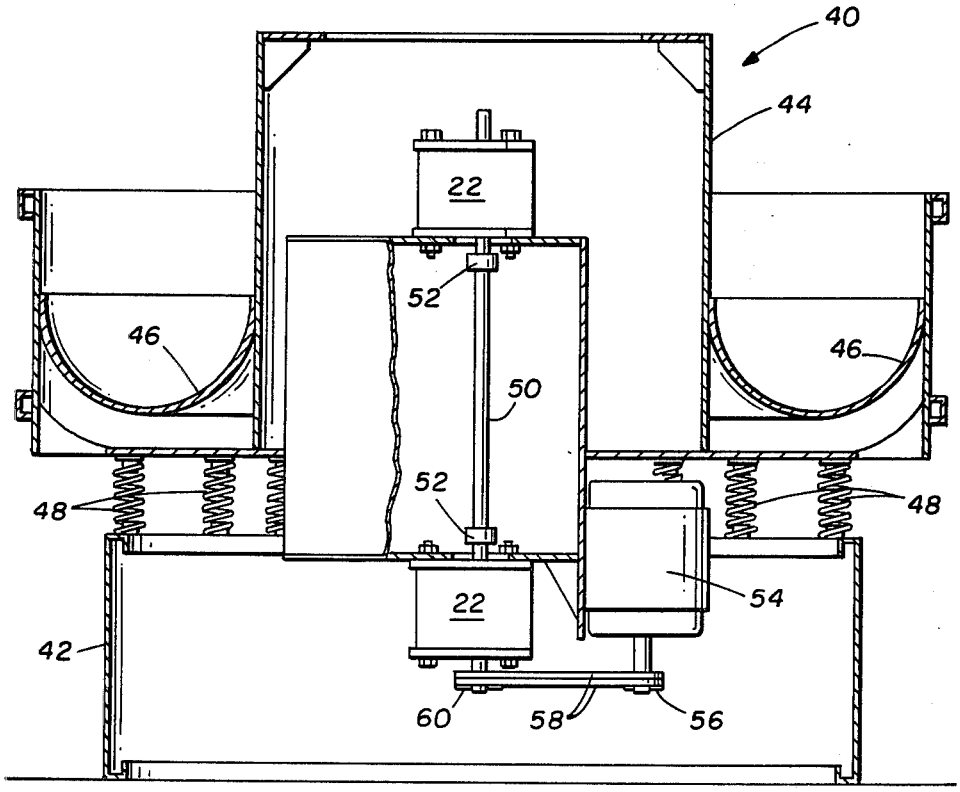
FIG. 2 is a partial sectional view of another vibratory machine utilizing the invention.
Figure 3:
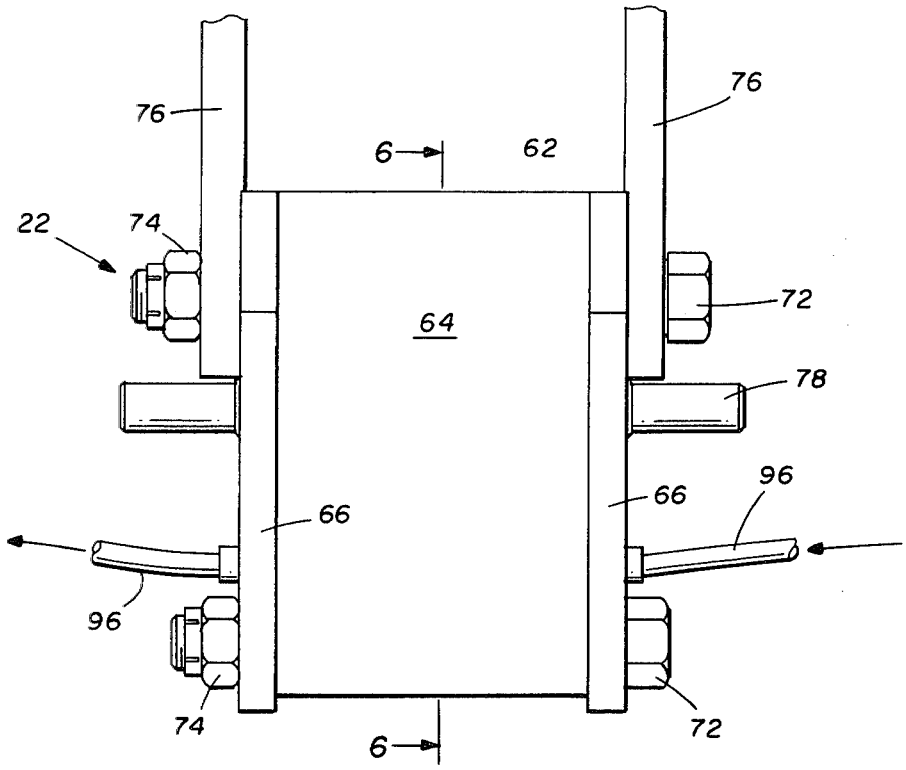
FIG. 3 is a side view of an eccentric vibratory actuator incorporating a first embodiment of the invention.
Figure 4:
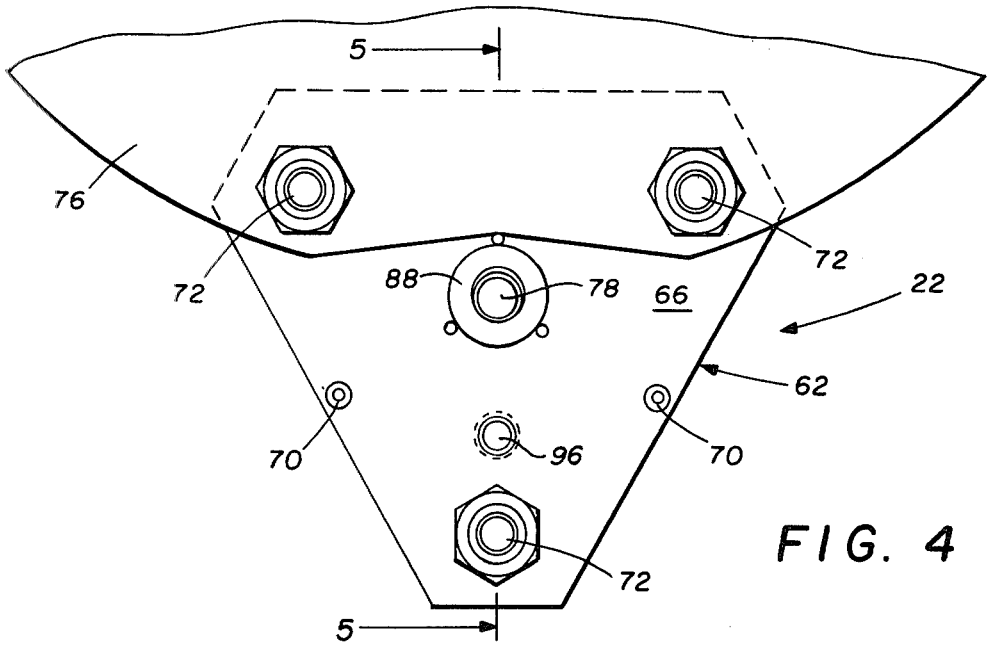
FIG. 4 is an end view of the actuator shown in FIG. 3.

FIG. 2 illustrates another vibratory machine 40 which can be driven by the actuators 22 of the invention. Machine 40 includes a base 42 supporting a frame 44 with a toroidal bowl 46 therein. Base 42 and frame 44 are interconnected by a plurality of springs 48 which isolate gyration of bowl 46 and the frame from the base during operation of machine 40. Springs 48 are illustrated as coil springs; however, air bags, elastomeric springs or other resilient mounting means can also be employed.

In contrast to machine 10, vibrating machine 40 utilizes a pair of vibratory actuators 22 mounted in vertically spaced apart orientation. Actuators 22 are bolted to frame 44, and are interconnected by shaft 50 and couplings 52. Units 22 are driven simultaneously by a motor 54 of the hydraulic or electric type mounted on base 42. Motor 54 includes a drive shaft with a pulley 56 secured thereto. Pulley 56 of motor 54 is connected by belts 58 to pulley 60 attached to the shaft of the lowermost eccentric vibratory actuator 22. Machine 40 does not include a lubrication system interconnecting actuators 22, although one can be used if desired.

Machines 10 and 40 operate in similar fashion and are utilized to perform finishing operations on piece parts. Piece parts to be finished are placed in the tub or bowl of the machine along with a suitable finishing media comprised of suitable liquid and abrasive particles or members. A finishing agent can also be added to the mixture, depending upon the type of finishing operation to be performed. The piece parts can be arranged loosely within the tub or bowl, or suspended therein by racks or the like. Eccentric vibratory actuators 22 are then operated to effect vibration of the piece parts and finishing media contained in the tub or bowl to perform the desired finishing operation. At the end of the operation, the finished piece parts and used finishing media are removed and the machine is prepared to receive the next batch of materials.

Although the eccentric vibratory actuators 22 of the invention have been illustrated herein as having application to vibratory finishing machines, it will be understood that the invention can be utilized in virtually any application where vibration or gyration is employed to perform a useful function. For example, the invention can be utilized with machines which perform material compaction, separation, screening, sifting or conveying operations; or machines which perform deburring, polishing or other surface treatment operations on piece parts. The vibratory apparatus herein can be used singly or in multiples, and can be mounted in any orientation. The vibratory apparatus herein has wide application.

Figure 5:
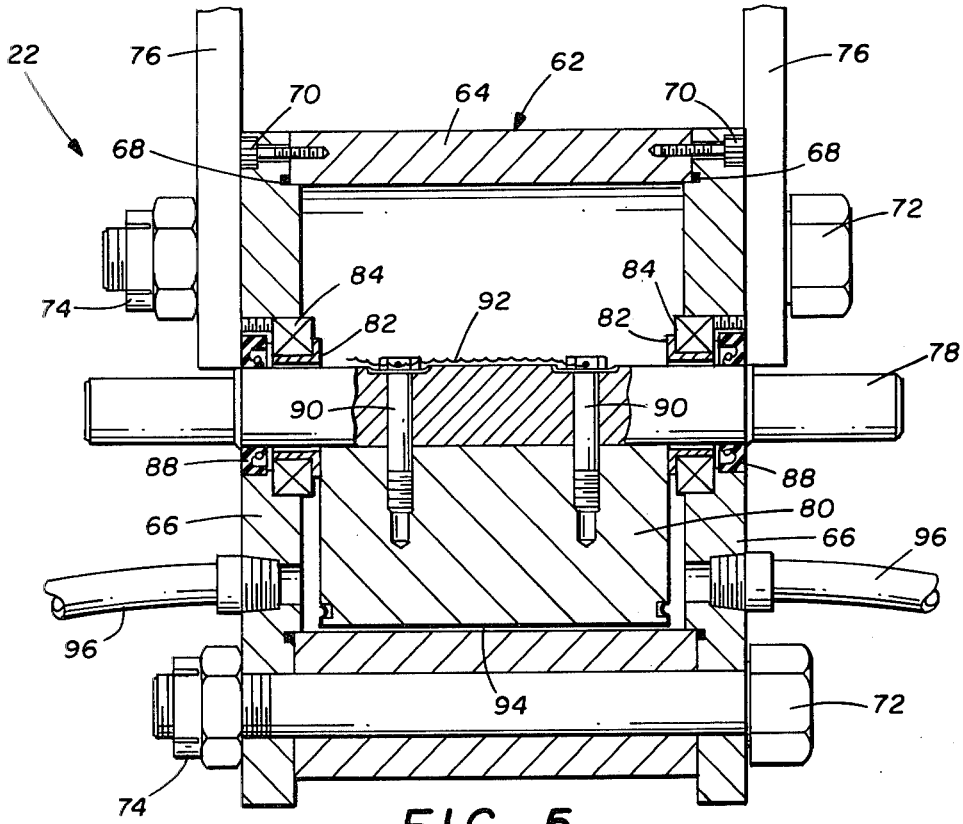
FIG. 5 is a sectional view taken along lines 5—5 of FIG. 3 in the direction of the arrows.

The constructional details of eccentric vibratory actuator 22 are shown in FIGS. 3–6. Each actuator 22 includes a housing 62 defining a cylindrical chamber therein. Housing 62 is comprised of a tubular wall member 64 and a pair of end plates 66. Member 64 can be of any external shape as long as the internal surface thereof is cylindrical. End plates 66 are illustrated as triangular, however, the particular shape of the end plates is not critical to the practice of the invention provided opposite ends of wall member 64 are closed thereby. Housing 62 can be constructed from any suitable rigid material, such as cast iron or other metal. As is best seen in FIG. 5, end plates 66 preferably include circular grooves within which O-rings 68 are seated for purposes of sealing housing 62.

Housing 62 of actuator 22 is secured by screws 70, bolts 72 and nuts 74. Any suitable number or type of fasteners can be utilized for connecting end plates 66 to wall member 64. As illustrated, each end plate 66 is attached by three cap screws 70 located at symetric intervals. Three bolts 72 in similar arrangement extend through end plates 66 and member 64 such that the head of each bolt is located on one side of housing 62 and a nut 74 is received on the threaded end portion thereof located on the opposite side of the housing. Bolts 72 and nuts 74 are preferably torqued to an equal predetermined value, such as 400 foot pounds, to avoid distorting circular wall member 64.

Brackets 76 connect actuator 22 to the object to be vibrated or shaken. Reinforcing ribs or other suitable flange portions of the object to be vibrated can be used for brackets 76. The shape of housing 62 in actuator 22 and its method of attachment are relevant only insofar as the housing is rigidly secured to the object to be actuated and the cylindrical interior of the housing is maintained. For example, housing 62 can be clamped, welded or otherwise rigidly attached to the object to be vibrated.

A central shaft 78 and partial shaft/eccentric weight 80 are supported for rotation within housing 62. As is best seen in FIG. 5, shaft 78 extends longitudinally through housing 62. Shaft 78 is loosely received by a bushing 82 and a thrust bearing 84 in each end plate 66. The purpose of bushings 82 and bearings 84 is to carry thrust loads on shaft 78 as partial shaft/eccentric weight 80 rotates on a hydrodynamic film inside housing 62. It will be understood that bushings 82 and bearings 84 do not provide rotational support for shaft 78 except incidentally when starting or stopping actuator 22. Annular seals 88 between shaft 78 and end plates 66 are provided outboard of thrust bearings 84. One end of shaft 78 is connected to a motor or other drive means, while the other end can be coupled to another actuator 22 or left free, as desired. If desired, the reduced end portions of shaft 78 can be offset from the central portions thereof as shown so that actuator 22 will shake about the drive axis, thereby reducing the flexure loading on a drive shaft (not shown) coupled to shaft 78.

Partial shaft/eccentric weight 80 mounts shaft 78 by bolts 90 and is mounted for rotation inside housing 62. A safety wire 92 can be used to secure bolts 90 against loosening, if desired. Weight 80 comprises a solid, partial cylindrical body formed of steel or other suitable material. Weight 80 extends between bushings 82 and substantially across the width of the chamber in housing 62. The ends of weight 80 are spaced inwardly from the inside surfaces of end plates 66 and away from contact therewith. A minute gap (which is greatly exaggerated in FIGS. 5 and 6) of a thickness corresponding to a suitable hydrodynamic film separates the outside cylindrical surface of weight 80 from the inside surface of member 64. For example, the gap between wall 64 and weight 80 can be on the order of 0.0004–0.0010 inch, depending upon the particular hydrodynamic fluid utilized.

Figure 6:
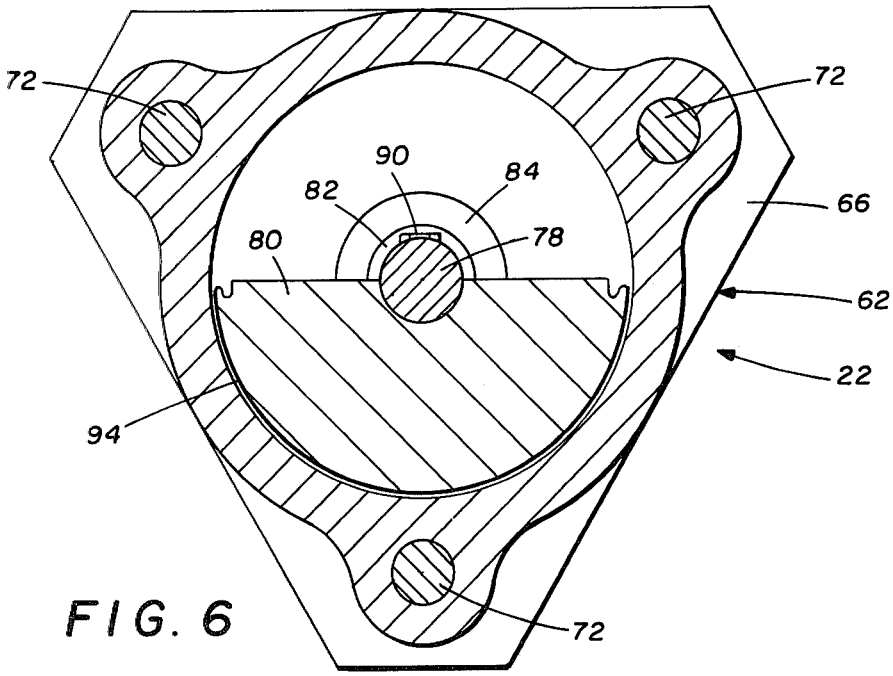
FIG. 6 is a sectional view taken along lines 6—6 of FIG. 4 in the direction of the arrows.

As shown, partial shaft/eccentric weight 80 is semi-cylindrical overall and semi-circular in cross section; however, the cross-sectional shape of the weight can be something other than about a 180° arc segment. For example, the cross-sectional shape of weight 80 can be 60°, 90°, 120°, 150° or other arc segments in accordance with the amount of shake force desired. The outer surface of weight 80 is preferably covered with a babbitt liner 94, and is preferably undercut or notched about the periphery as shown in FIGS. 5 and 6 to facilitate connection of the liner to the weight. It will be understood that the configuration of weight 80 and its relationship with housing 62 comprise significant features of the present invention.

Housing 62 of eccentric vibratory actuator 22 contains a suitable hydrodynamic fluid such as water or light oil. Other non-volatile fluids of low viscosity may also be suitable for use in actuator 22. In some applications, air or other gases may also be suitable.

Hydrodynamic fluid thus fills the gap between eccentric weight 80 and wall member 64 housing 62. Depending upon the speed of operation, vibrational force and heat generated by actuator 22, it may be desirable to circulate fluid therethrough for purposes of cooling and lubricant replenishment. When desired, fluid can be circulated through housing 62 by means of supply and return lines 96 connected to ports provided in end plates 66. Circulation of hydrodynamic fluid through housing 62, however, may not be necessary in some applications of the invention, and it will be understood the actuator 22 can be operated as a sealed unit.

Upon rotation of shaft 78, partial shaft/eccentric weight 80 turns inside housing 62 separated from wall member 64 by a thin film of hydrodynamic fluid. Since shaft 78 is loosely constrained within bushings 82 and thrust bearings 84, the hydrodynamic film thickness between housing 62 and weight 80 depends upon the particular fluid employed. As weight 80 rotates, vibratory forces are generated and transferred through housing 62 to the tub or bowl to which actuator 22 is attached. Actuator 22 thus functions as a hydrodynamic journal bearing with eccentric weight 80 as a partial journal and cylindrical wall 64 as a full bearing. The loading on the journal surface of weight 80 is constant rather than cyclical such that fatigue of liner 94 is reduced. The centrifugal loading is distributed more uniformly between wall member 64 and weight 80 to minimize and virtually eliminate deflection between housing 62 and the eccentrically weighted shaft 78.

Maintenance of the proper hydrodynamic film thickness is thus facilitated, and the bearing pressures are relatively low due to the large surface area of wall member 64. What little deflection does occur has the effect of thinning the hydrodynamic film at the ends of weight 80, thereby tending to raise the supporting pressure at a point where it would otherwise decrease in conventional journal bearings. Moreover, the motion of eccentric weight 80 is contained by housing 62 resulting in quieter and safer operation. When two or more actuators 22 are interconnected, the phase of the forced vibrations produced thereby can readily be changed by initially adjusting the relative rotational positions of shafts 78 and weights 80.

From the foregoing, it will be understood that the present invention comprises an eccentric vibratory apparatus having numerous advantages over the prior art. The invention herein features simplified and less expensive construction, and eliminates the problems of structural deflection and maintenance of sufficient hydrodynamic film which have plagued the prior art. Other advantages will readily be apparent to those skilled in the art.

Although particular embodiments of the invention have been illustrated in the Drawings and described in the Detailed Description, it will be understood that the invention is not limited to the embodiments disclosed, but is intended to embrace any alternatives, modifications, and rearrangements and/or substitutions of elements as fall within the scope of the invention.

I claim:

1. A vibratory actuator, comprising:

a housing with an inner bearing surface of full cylindrical configuration;

eccentric means rotatably supported in said housing for generating vibration responsive to rotation thereof;

said eccentric means including an outer journal surface of partial cylindrical configuration extending in spaced apart relationship with the bearing surface of said housing to form a fluid film gap therebetween; and fluid means disposed in said housing for hydrodynamically supporting said eccentric means during rotation within said housing.

2. The vibratory actuator of claim 1, wherein said housing comprises:

a tubular member with open ends; and a pair of end plates, one plate being secured to each end of said tubular member.

3. The vibratory actuator of claim 1, wherein said eccentric means comprises:

an offset member with the journal surface being located on said offset member; and a rotatable shaft extending through said housing and being secured to said offset member for effecting rotation thereof.

4. The vibratory actuator of claim 1, wherein the journal surface of said eccentric means extends longitudinally within said housing adjacent to a major portion of the bearing surface.

5. The vibratory actuator of claim 1, wherein the journal surface of said eccentric means extends circumferentially within said housing over an arc ranging between about 60° and about 180 °.

6. The vibratory actuator of claim 1, further including:

means for circulating said fluid through said housing.

7. A vibratory actuator, which comprises:

a rigid housing with an inner bearing surface of full cylindrical configuration;

a rotatable shaft extending longitudinally through said housing;

an eccentric member secured to said shaft inside said housing for generating vibration responsive to rotation by said shaft;

said eccentric member including an outer journal surface of partial cylindrical configuration extending in spaced apart relationship with the bearing surface to form a fluid film gap therebetween; and hydrodynamic fluid disposed in said housing for lubricating rotation of said eccentric member relative to said housing.

8. The vibratory actuator of claim 7, wherein said rigid housing comprises:

a tubular member with open ends; and a pair of end plates, one plate being secured to each end of said tubular member.

9. The vibratory actuator of claim 7, wherein the journal surface of said eccentric member extends longitudinally adjacent to a major portion of the bearing surface.

10. The vibratory actuator of claim 7, wherein the journal surface of eccentric member extends circumferentially over an arc ranging between about 60° and about 180°.

11. The vibratory actuator of claim 7, further including:

a babbitt liner attached to the journal surface of said eccentric member.

12. The vibratory actuator of claim 7, further including:

means for circulating the hydrodynamic fluid through said housing.

13. Vibratory apparatus for use with a fluid lubricant, comprising:

a rigid housing with an internal bearing surface of full cylindrical configuration;

a rotatable shaft extending longitudinally through said housing;

means for supporting said shaft in opposite ends of said housing; and an eccentric member secured to said shaft inside said housing for producing vibration upon rotation by said shaft;

said eccentric member including an external journal surface of arcuate configuration extending in spaced apart relationship with the bearing surface to form a gap therebetween dependent upon the hydrodynamic film thickness of the fluid lubricant in said housing which lubricates rotation of said eccentric member relative to said housing.

14. The vibratory apparatus of claim 13, wherein the journal surface of said eccentric member extends longitudinally adjacent to a major portion of the bearing surface.

15. The vibratory apparatus of claim 13, wherein the journal surface of said eccentric member extends circumferentially over an arc ranging between about 60° and about 180°.

16. The vibratory apparatus of claim 13, wherein the means for rotatably supporting said shaft comprises:

bearing means surrounding said shaft in circumferentially spaced relationship and mounted in each end of said housing; and seal means surrounding said shaft and mounted in each end of said housing adjacent to said bearing means.

17. The vibratory apparatus of claim 13, wherein both ends of said shaft are offset from that shaft portion extending through said housing.

18. In combination with a machine of the type having drive means and an apparatus responsive to vibratory actuation for performing a predetermined function, a vibratory actuator comprising:

a housing attached to the apparatus, said housing having an inner bearing surface of full cylindrical configuration;

eccentric means coupled to the drive means and rotatably supported in said housing for generating vibration;

said eccentric means including an outer journal surface of partial cylindrical configuration extending in spaced apart relationship with the bearing surface of said housing to form a hydrodynamic fluid film gap therebetween; and fluid disposed in said housing for hydrodynamically supporting said eccentric means during rotation within said housing.

19. The vibratory actuator of claim 18, wherein said eccentric means comprises:

an offset member with the journal surface being located on said member; and a rotatable shaft extending through the housing and being secured to said offset member for effecting rotation thereof.

20. The vibratory actuator of claim 18, wherein the journal surface of said eccentric means extends longitudinally adjacent to a major portion of the bearing surface.

21. The vibratory actuator of claim 18, wherein the journal surface of said eccentric means extends circumferentially over an arc ranging between about 60° and about 180°.

22. The vibratory actuator of claim 18, further including:

means for circulating said fluid through said housing.

* * * * *